US009236038B1

(12) United States Patent
Hirasawa

(10) Patent No.: US 9,236,038 B1
(45) Date of Patent: Jan. 12, 2016

(54) PEDAL DEVICE FOR DRUM

(71) Applicant: HOSHINO GAKKI CO., LTD., Nagoya (JP)

(72) Inventor: Satoshi Hirasawa, Nagoya (JP)

(73) Assignee: HOSHINO GAKKI CO., LTD., Nagoya (JP)

( * ) Notice: Subject to any disclaimer, the term of this patent is extended or adjusted under 35 U.S.C. 154(b) by 0 days.

(21) Appl. No.: 14/693,877

(22) Filed: Apr. 23, 2015

(30) Foreign Application Priority Data

Nov. 13, 2014 (JP) ..... 2014-230984

(51) Int. Cl.
*G10D 13/02* (2006.01)
*G10D 13/00* (2006.01)

(52) U.S. Cl.
CPC ..... *G10D 13/006* (2013.01)

(58) Field of Classification Search
CPC ..... G10D 13/006
USPC ..... 84/422.1
See application file for complete search history.

(56) References Cited

U.S. PATENT DOCUMENTS

| | | | | |
|---|---|---|---|---|
| 2,027,869 | A | 1/1936 | La Londe | |
| 6,590,147 | B2 | 7/2003 | Kassabian | |
| 7,301,088 | B2 | 11/2007 | Chen | |
| 7,968,781 | B1 * | 6/2011 | Luo | 84/422.1 |
| 2002/0056357 | A1 | 5/2002 | Kassabian | |

FOREIGN PATENT DOCUMENTS

| | | | |
|---|---|---|---|
| JP | 2007-017805 | A | 1/2007 |

* cited by examiner

*Primary Examiner* — Jianchun Qin

(57) ABSTRACT

A drum pedal includes a unit body, a pedal, a chain belt, a shaft, a beater, and a tension coil spring. The tension coil spring has a lower end coupled through a bolt, an adjusting nut, and a locking nut to a bracket fixed to a column. The tension coil spring pivots together with the bolt and the adjusting and locking nuts relative to the bracket. A pivot fulcrum of the tension coil spring is provided on the lower surface of the bracket contacting the adjusting nut.

10 Claims, 8 Drawing Sheets

PEDAL DEVICE FOR DRUM

BACKGROUND OF THE INVENTION

This invention relates to a pedal device used for playing of a drum such as a bass drum.

As disclosed in Japanese Patent Application Publication No. 2007-017805, a pedal device of this kind includes a base plate, a pedal, a chain, a rotary shaft, a beater, a tension coil spring, and others. Columns in a pair extend upward from the front end of the base plate. The rotary shaft is rotationally supported on the respective upper ends of the columns in a pair. The beater and a wheel are attached to the center of the rotary shaft. The pedal is rotationally attached to the rear end of the base plate. One end of the chain is coupled to the rotary shaft while being wound around the wheel. The opposite end of the chain is coupled to a free end of the pedal. The upper end of the tension coil spring is coupled through a coupling ring to a crank arm attached to an end portion of the rotary shaft. The lower end of the tension coil spring is coupled to the upper end of the bolt that adjusts the tension of the tension coil spring. The bolt is fixed to a bracket projecting from one of the columns with an upper nut and a lower nut in a pair. When the pedal is depressed against the biasing force of the tension coil spring, the beater is rotated by the chain, the wheel, and the rotary shaft to beat a bass drum. When the pedal is released from the depression, the biasing force of the tension coil spring makes the beater and the pedal return to their initial positions.

As shown in FIG. 10, when a player operates a pedal to rotate a beater 100 back and forth, a tension coil spring 101 pivots back and forth about the lower end of the tension coil spring 101, which is a fulcrum coupled to a bolt 102. At this time, if the tension coil spring 101 swings back and forth, if the pivot angle A101 of the tension coil spring 101 is increased, the force P of a horizontal component acting on a swinging fulcrum F101 is also increased. This makes the entire pedal device swing back and forth easily together with the pivot motion of the tension coil spring 101, thereby reducing the operability of the pedal. The large backward and forward swinging motion of the tension coil spring 101 also increases the force of friction between the lower end of the tension coil spring 101 and the bolt 102. This increase in the force of friction between the tension coil spring 101 and the bolt 102 reduces smooth movement of the pedal and further reduces the operability of the pedal.

SUMMARY OF THE INVENTION

It is an object of this invention to provide a pedal device for a drum that improves the operability of a pedal by making a spring swing by a smaller angle during operation on the pedal.

To solve the aforementioned problem, one aspect of this invention provides a pedal device for a drum. The pedal device includes: a unit body having a base and a column extending upward from a front end of the base; a pedal rotationally attached to a rear end of the base; a shaft supported on an upper end of the column; a beater provided on the shaft, the beater rotating around an axis of the shaft to beat a drum; a crank arm that rotates around the axis of the shaft together with the beater; a transmission member coupled to a free end of the pedal, the transmission member transmitting operating force of the pedal to the beater; and a spring with an upper end coupled to the crank arm and a lower end coupled to the unit body. The spring has an axis. The pedal is held in a standby position by the spring while the axis of the spring lies in a common plane with a reference line connecting the lower end of the spring and a rotation center of the crank arm. The operating force of the pedal is transmitted through the transmission member to the beater to rotate the beater and the crank arm rotating together with the beater makes the spring swing back and forth on the lower end of the spring as a fulcrum. The unit body is provided with a bracket that supports the spring in a manner allowing the spring to swing. The swinging fulcrum of the spring is provided on a lower surface of the bracket.

DETAILED DESCRIPTION OF THE PREFERRED EMBODIMENTS

An embodiment that embodies a pedal device of this invention for a drum is described below by referring to FIGS. 1 to 7B.

Figure 1:
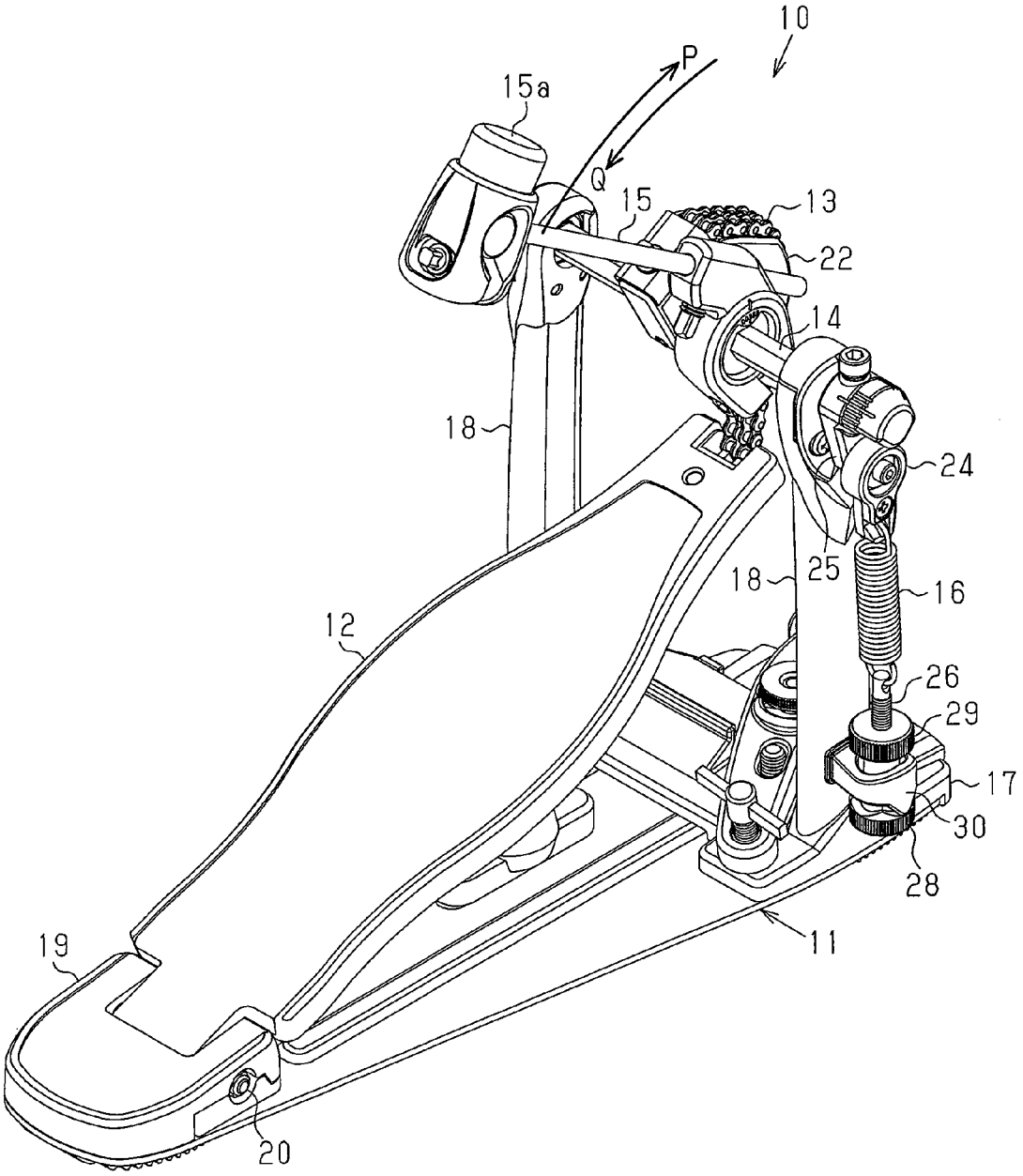
FIG. 1 is a perspective view showing a pedal device according to an embodiment of this invention.

As shown in FIG. 1, a drum pedal 10 includes a unit body 11, a pedal 12, a chain belt 13 as a transmission member, a shaft 14, a beater 15, and a tension coil spring 16. The unit body 11 is formed of a base 17 and columns 18 in a pair extending upward from the front end of the base 17. The columns 18 in a pair are separated by a distance. A heel part 19 is attached to the rear end of the base 17. The rear end of the pedal 12 is rotationally attached to the heel part 19 through a support shaft 20. The front end of the pedal 12 is arranged between the columns 18 in a pair.

The shaft 14 is rotationally supported on the respective upper ends of the columns 18 in a pair. The beater 15 and a wheel 22 are attached to the substantially central part of the shaft 14. One end of the chain belt 13 is fixed while being wound around the circumferential surface of the wheel 22. The opposite end of the chain belt 13 is fixed to a free end of the pedal 12 corresponding to the front end of the pedal 12. The chain belt 13 is supported by the wheel 22 and the pedal 12 to be pulled downward by the weight of the pedal 12 itself.

The upper end of the tension coil spring 16 is coupled to an end portion of the shaft 14 through a ring 24 and a crank arm 25. The lower end of the tension coil spring 16 is coupled through a bolt 26, an adjusting nut 28, and a locking nut 29 to a bracket 30 fixed to one of the columns 18. The tension coil spring 16 is supported by the ring 24 and the bolt 26 to be stretched along the axis of the column 18. In this condition, the tension coil spring 16 holds the beater 15 in a resting position of FIG. 1 and the pedal 12 in a standby position of FIG. 1.

The drum pedal 10 is used while a beating surface 15*a* of the beater 15 is arranged to face a bass drum not shown in the drawings and the base 17 is coupled to the bass drum. When a player depresses the pedal 12 of the drum pedal 10 with his or her foot, the force of the depression is transmitted through the chain belt 13 to the wheel 22. Then, the beater 15 rotates in a direction P of FIG. 1 together with the wheel 22 and the shaft 14. When the player releases the pedal 12 from the depression, the biasing force of the tension coil spring 16 rotates the beater 15 in a direction Q of FIG. 1 together with the wheel 22 and the shaft 14. In this way, the pedal 12 is moved up and down with a foot, thereby moving the beater 15 back and forth together with the shaft 14.

Figure 2:
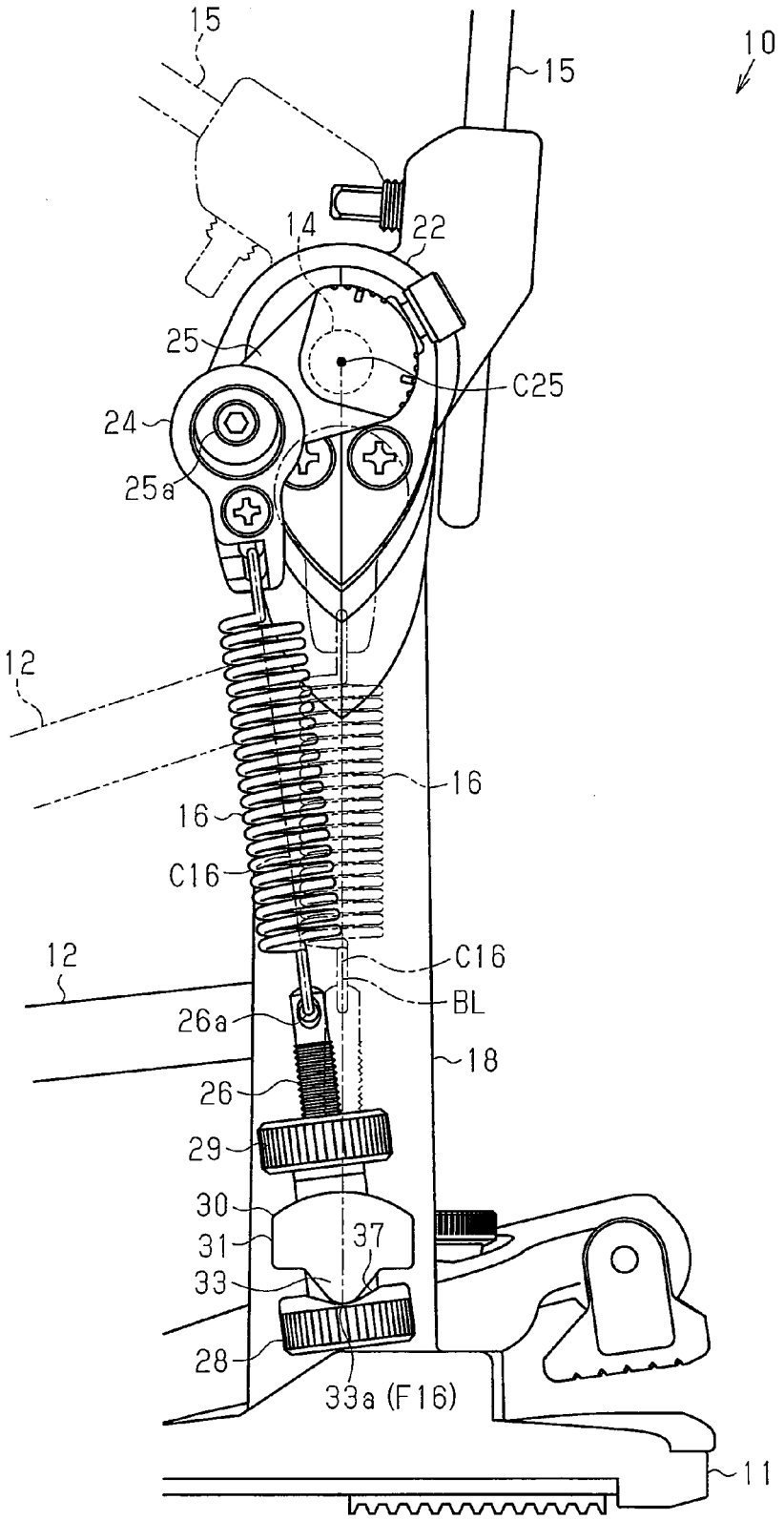
FIG. 2 is a partial side view showing a bracket and its vicinity of the pedal device in an enlarged manner.

As shown in FIG. 2, while being fixed to a position near the lower end of the column 18, the bracket 30 supports the tension coil spring 16 together with the bolt 26 and the adjusting and locking nuts 28 and 29 in a manner allowing the tension coil spring 16 to swing together with the bolt 26 and the adjusting and locking nuts 28 and 29. A coupling hole 26*a* is formed in the upper end of the bolt 26. The lower end of the tension coil spring 16 is coupled to the coupling hole 26*a* in the bolt 26. The tension coil spring 16 pivots together with the bolt 26 and the adjusting and locking nuts 28 and 29 relative to the bracket 30. A pivot fulcrum F16 of the tension coil spring 16 is provided on the lower surface of the bracket 30 contacting the adjusting nut 28.

Figure 3:
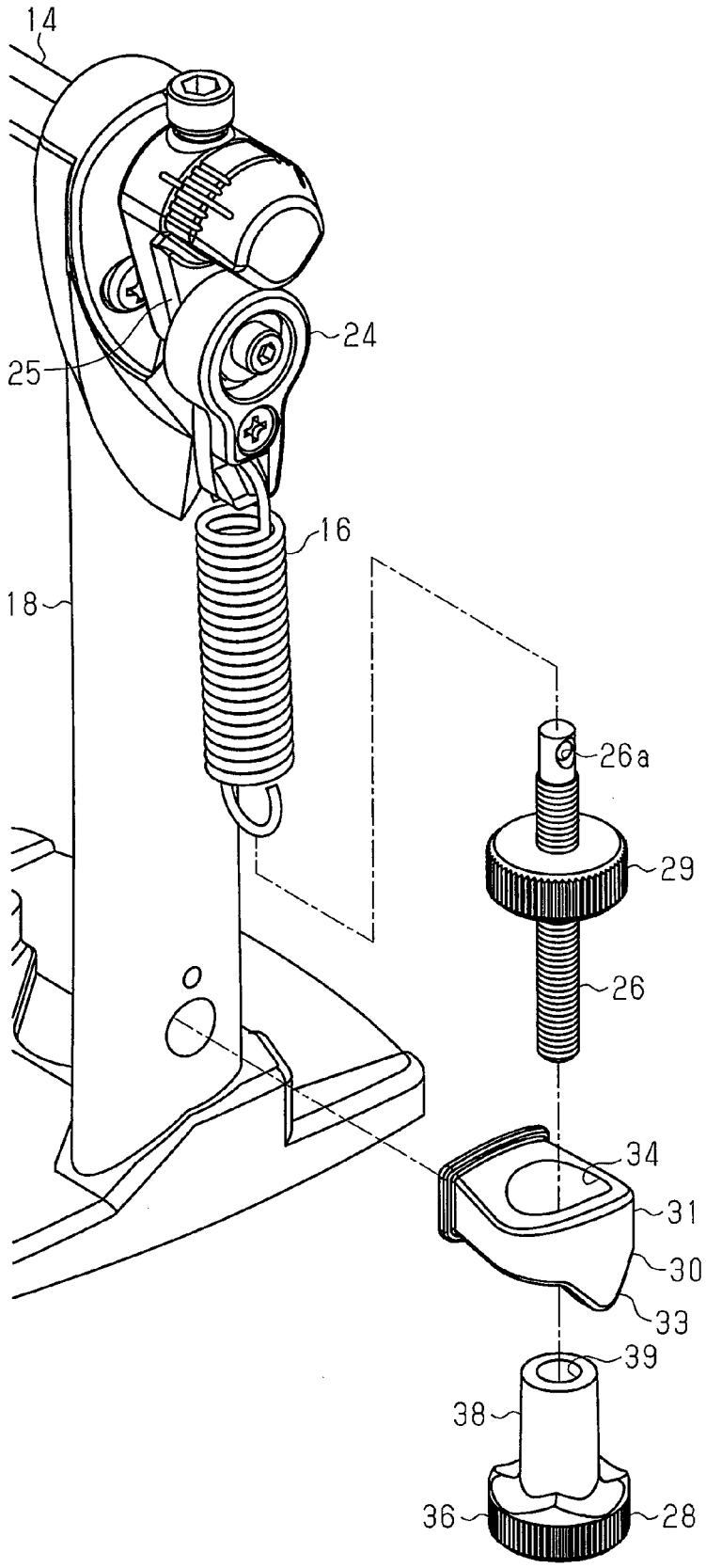
FIG. 3 is an exploded perspective view showing the bracket and its vicinity of the pedal device in an enlarged manner.
Figure 4A:
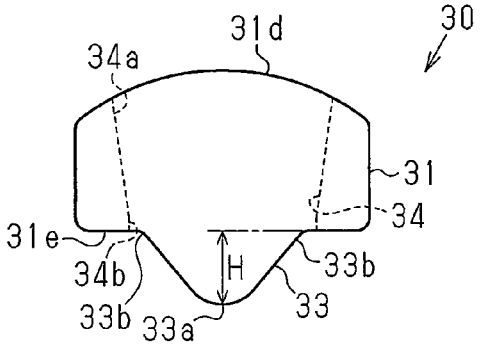
FIG. 4A is a side view of the bracket.
Figure 4B:
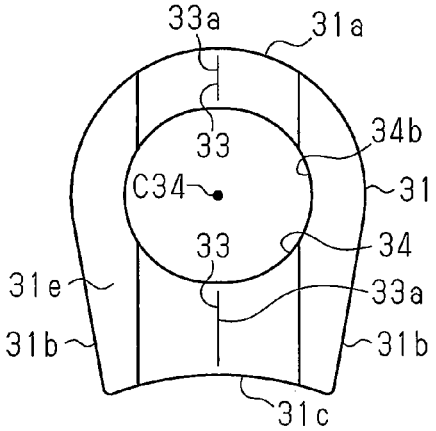
FIG. 4B is a bottom view of the bracket.

As shown in FIGS. 3, 4A, and 4B, the bracket 30 includes a bracket body 31 and a projection 33 projecting from the lower surface of the bracket body 31. A vertical hole 34 is formed in the substantially central part of the bracket body 31. The vertical hole 34 is formed into a circular shape in a horizontal section. The vertical hole 34 is formed into a tapered shape in a vertical section with an upper opening end 34*a* larger than a lower opening end 34*b*. The bolt 26 passes through the vertical hole 34 in the bracket 30 from above and the adjusting nut 28 passes through the vertical hole 34 from below.

The bracket body 31 has a front surface 31*a*, side surfaces 31*b* in a pair, a rear surface 31*c*, an upper surface 31*d*, and a lower surface 31*e*. The front surface 31*a*, the side surfaces 31*b* in a pair, and the rear surface 31*c* are arranged to surround the vertical hole 34. The front surface 31*a* is curved along an arc coaxial with the vertical hole 34. The front surface 31*a* and the side surfaces 31*b* in a pair together form a substantially U-shaped surface. The rear surface 31*c* is curved to have the same shape as the outer side surface of the column 18. The upper opening end 34*a* of the vertical hole 34 is formed in the upper surface 31*d*. The upper surface 31*d* is curved downward further in a position at a shorter distance from the center of the vertical hole 34 to each side surface 31*b*. The lower opening end 34*b* of the vertical hole 34 is formed in the lower surface 31*e*. The lower surface 31*e* is flat in a part except the lower opening end 34*b*.

The projection 33 contacts the adjusting nut 28. The projection 33 is a first contact part contacting the tension coil spring 16 indirectly through the bolt 26 and the adjusting nut 28. The projection 33 is formed of projections 33 in a pair with respect to an axis C34 of the vertical hole 34 as a center. The projection 33 is formed to have a substantially triangular sectional shape. The projection 33 has a tip 33*a* that has an arcuate sectional shape. The tip 33*a* of the projection 33 extends along a straight line perpendicular to the axis C34 of the vertical hole 34. The projection 33 is formed integrally with the lower surface of the bracket body 31 with the tip 33*a* pointed downward.

Figure 5A:
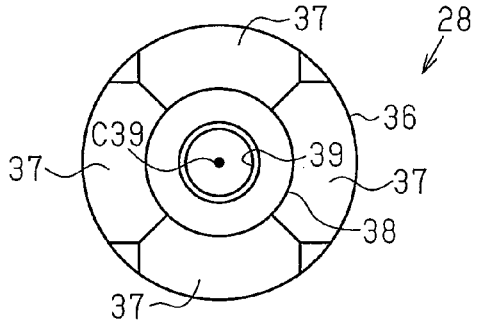
FIG. 5A is a top view of an adjusting nut.
Figure 5B:
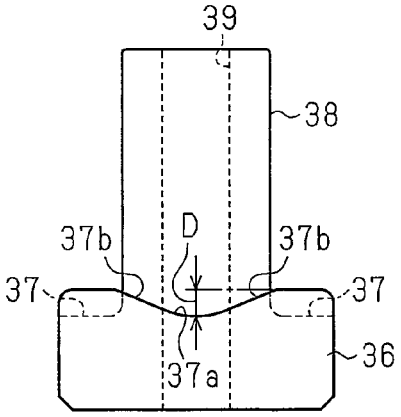
FIG. 5B is a side view of the adjusting nut.

As shown in FIGS. 3, 5A, and 5B, the adjusting nut 28 includes a retainer 36 contacting the projection 33 of the bracket body 31, a tubular part 38 projecting from the upper surface of the retainer 36, and a screw hole 39 passing through the retainer 36 and the tubular part 38 in the vertical direction. Threads on the lower end of the bolt 26 are engaged with corresponding threads in the screw hole 39 in the adjusting nut 28. Operating the adjusting nut 28 adjusts the position of the bolt 26 in the direction of the axis to control the tension of the tension coil spring 16.

A recess 37 that can fit the projection 33 of the bracket 30 is formed in the upper surface of the retainer 36. The recess 37 supports the tension coil spring 16 together with the bolt 26 and the adjusting and locking nuts 28 and 29 in a manner allowing the tension coil spring 16 to swing together with the bolt 26 and the adjusting and locking nuts 28 and 29. The recess 37 is a second contact part contacting the projection 33 of the bracket 30. The recess 37 is formed of two recesses 37 passing through an axis C39 of the screw hole 39. Each of the two recesses 37 extends along a straight line perpendicular to the axis C39 of the screw hole 39. The two recesses 37 cross each other at right angles on the axis C39 of the screw hole 39.

The two recesses 37 have the same shape and the same size. Each of the recesses 37 is formed to have a substantially triangular sectional shape. Each of the recesses 37 has a bottom surface 37*a* formed of an arcuate surface of an arcuate sectional shape and an opening surface 37*b* extending from the bottom surface 37*a* to be continuous with the upper surface of the retainer 36. The bottom surface 37*a* of the recess 37 in the retainer 36 has an R value set to be larger than that of the tip 33*a* of the projection 33 of the bracket 30. The recess 37 in the retainer 36 has a depth D set to be smaller than a height H of the projection 33 of the bracket 30. The recess 37 in the retainer 36 has a width set to be the same as that of the projection 33 of the bracket 30.

Figure 6A:
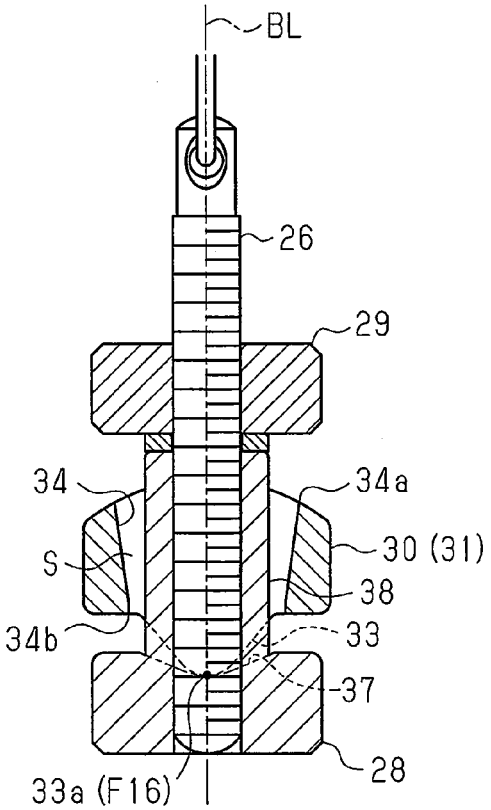
FIG. 6A is a partial sectional view showing the bracket and its vicinity of the pedal device in an enlarged manner while a beater is in a resting position.

As shown in FIGS. 3 and 6A, the bolt 26 passes through the vertical hole 34 in the bracket body 31. The upper end of the bolt 26 extends upward from the upper opening end 34*a* of the vertical hole 34. The lower end of the bolt 26 extends downward from the lower opening end 34*b* of the vertical hole 34. Inner threads on the adjusting nut 28 are engaged with corresponding outer threads on the lower end of the bolt 26. Inner threads on the locking nut 29 are engaged with corresponding outer threads on the upper end of the bolt 26. The locking nut 29 is tightened on the bolt 26 until the locking nut 29 abuts on the tip of the tubular part 38 of the adjusting nut 28. In this way, the adjusting nut 28, which is threaded to the bolt 26, is locked with the locking nut 29.

Figure 6B:
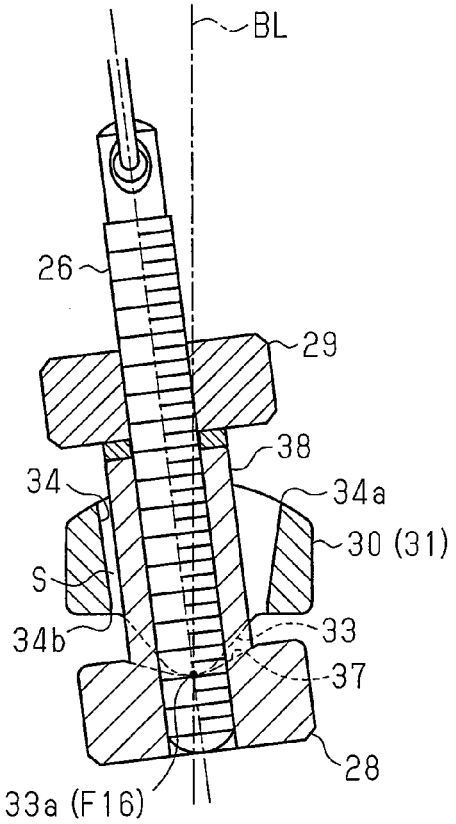
FIG. 6B is a partial sectional view showing the bracket and its vicinity of the pedal device in an enlarged manner while the beater is in a beating position.

The action of the aforementioned drum pedal 10 is described next by referring to FIGS. 2, 6A, and 6B.

As shown by broken lines in FIG. 2, while the pedal 12 is not depressed, the beater 15 and the pedal 12 are placed in the resting and standby positions respectively. In this condition, the tension coil spring 16 is supported while stretched along the axis of the column 18 by the ring 24 and the bolt 26. At this time, an axis C16 of the tension coil spring 16 lies in a common plane with a reference line BL that connects the tip 33*a* of the projection 33, which is the pivot fulcrum F16 of the tension coil spring 16, and a rotation center C25 of the crank arm 25. In the illustrated embodiment, the axis C16 coincides with the reference line BL. At this time, like that of the tension coil spring 16, the respective axes of the locking nut 29, the bolt 26, and the adjusting nut 28 lie in a common plane with the reference line BL as shown in FIG. 6A. A gap S is maintained between the bracket body 31 and the tubular part 38 of the adjusting nut 28, and the gap increases as the distance increases from the lower opening end 34*b* toward the upper opening end 34*a* of the vertical hole 34. In other words, the vertical hole is tapered or conical, and the width of the vertical hole increases as the distance from the lower opening end 34*b* increases, as shown in FIG. 6(*a*).

As shown by solid lines of FIG. 2, when the pedal 12 is depressed, the beater 15 rotates together with the wheel 22 and the shaft 14 to be placed in a beating position to beat the bass drum. At this time, together with the rotation of the shaft 14, the crank arm 25 rotates in the same direction as the shaft 14. This pulls the ring 24 locked with a protrusion 25*a* at the lower end of the crank arm 25 obliquely upward. Thus, the upper end of the tension coil spring 16 is pulled upward by the ring 24 while the lower end of the tension coil spring 16 is still coupled to the upper end of the bolt 26. At this time, the axis C16 of the tension coil spring 16 is tilted about the pivot fulcrum F16 relative to the reference line BL. At this time, like that of the tension coil spring 16, the respective axes of the locking nut 29, the bolt 26, and the adjusting nut 28 are tilted about the pivot fulcrum F16 relative to the reference line BL as shown in FIG. 6B. Even in this condition, the gap S maintained between the bracket body 31 and the tubular part 38 is large enough to prevent interference between the circumferential wall of the vertical hole 34 and the tubular part 38 of the adjusting nut 28.

The pivot angle of the tension coil spring 16 in the drum pedal 10 of this embodiment and that of a tension coil spring 101 in a conventional drum pedal 110 are compared. A result of the comparison is described next by referring to FIGS. 7A and 7B.

Figure 7A:
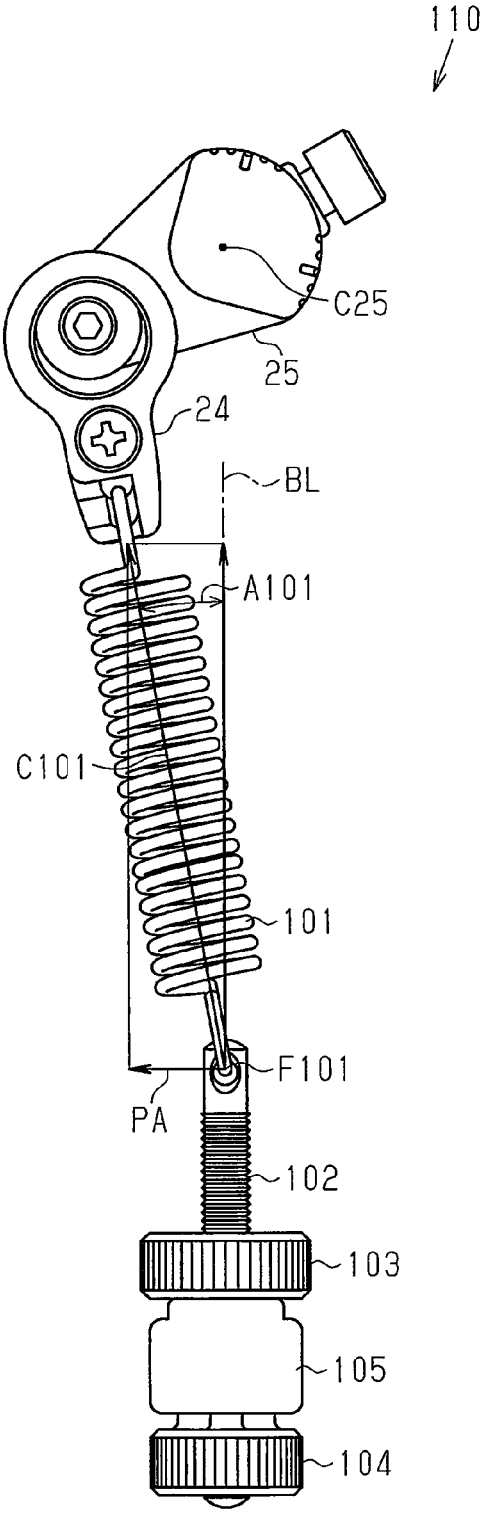
FIG. 7A is a schematic view showing a swinging angle of a tension coil spring in a conventional pedal device.
Figure 7B:
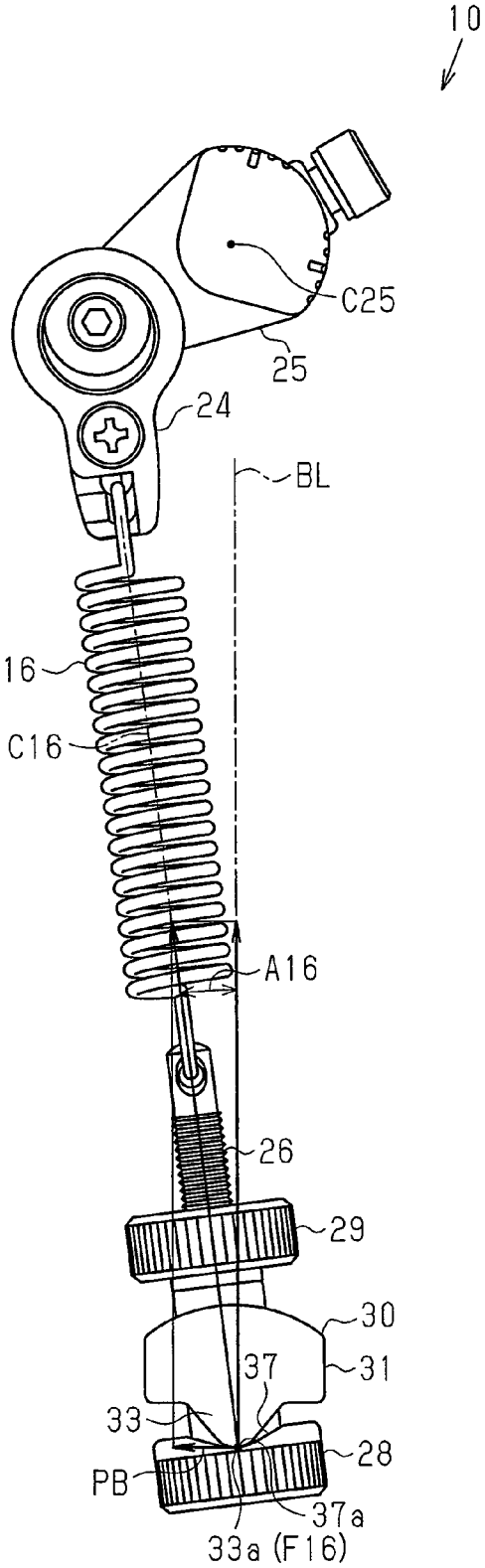
FIG. 7B is a schematic view showing a swinging angle of a tension coil spring in the pedal device of this embodiment.

As shown in FIGS. 7A and 7B, the drum pedal 10 of this embodiment has the following in common with the conventional drum pedal 110: the tension coil springs 16 and 101 are supported by the ring 24 and the bolt 26. The drum pedal 10 of this embodiment differs from the conventional drum pedal 110 in that the pivot fulcrum F16 of the tension coil spring 16 is defined not at the upper end of the bolt 26 but on the lower surface of the bracket 30.

Figure 10:
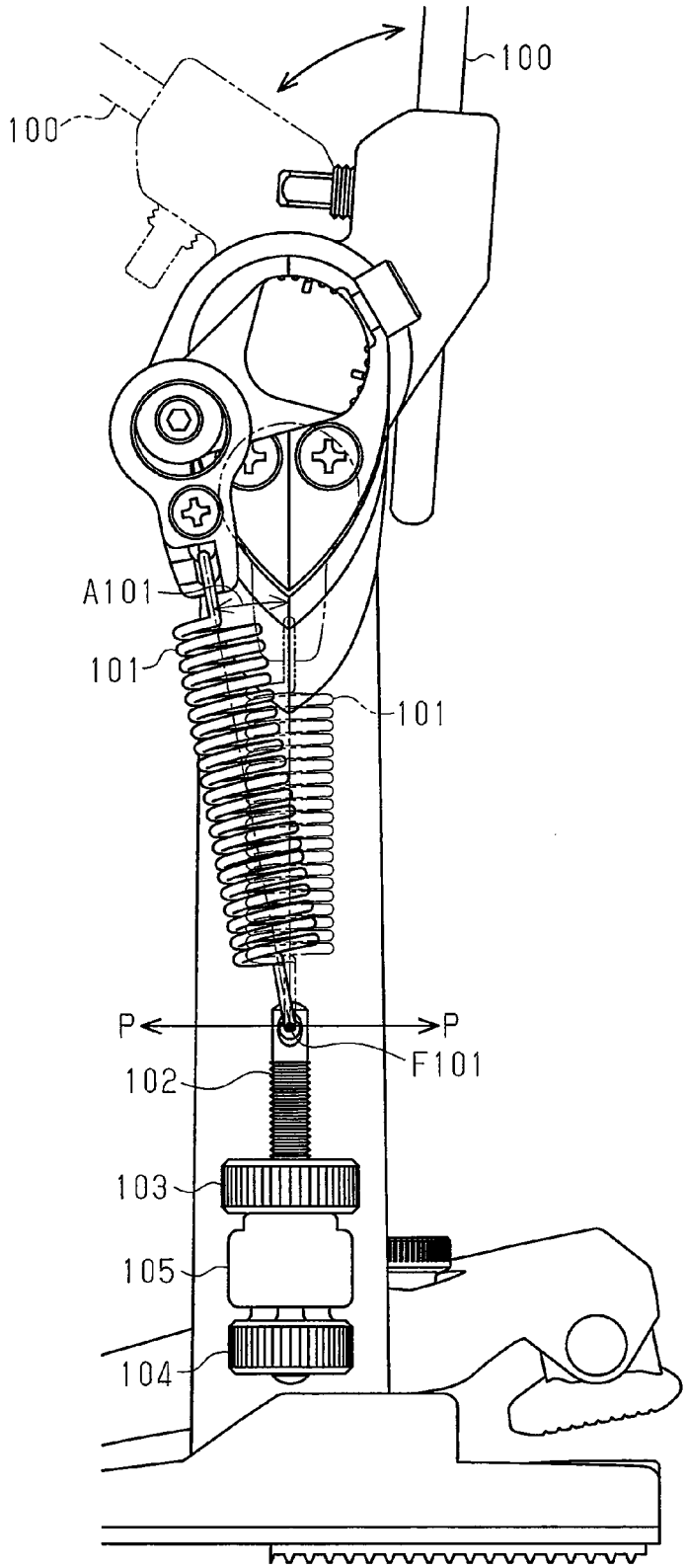
FIG. 10 is a partial side view showing a bracket and its vicinity of the conventional pedal device in an enlarged manner.

As shown in FIGS. 7A and 10, in the conventional drum pedal 110, a bolt 102 is fixed to a bracket 105 projecting from a column with an upper nut 103 and a lower nut 104 in a pair. In this structure, operation on a pedal makes only the tension coil spring 101 swing back and forth. Thus, the tension coil spring 101 pivots on a point of coupling to the bolt 102 as a fulcrum. At this time, a pivot fulcrum F101 of the tension coil spring 101 corresponds to the lower end of the tension coil spring 101 and the upper end of the bolt 102. A pivot angle A101 of the tension coil spring 101 is an angle between an axis C101 of the tension coil spring 101 and a reference line BL.

As shown in FIG. 7B, in the drum pedal 10 of this embodiment, the bolt 26 is supported together with the adjusting and locking nuts 28 and 29 by the bracket 30 projecting from a column such that the bolt 26 can swing together with the adjusting and locking nuts 28 and 29. In this structure, operation on a pedal makes the tension coil spring 16 swing together with the bolt 26 and the adjusting and locking nuts 28 and 29. Thus, the tension coil spring 16, the bolt 26, and the adjusting and locking nuts 28 and 29 swing on a point as a fulcrum where the adjusting nut 28 in the lowest position contacts the bracket 30. The pivot fulcrum F16 of the tension coil spring 16, the bolt 26, and the adjusting and locking nuts 28 and 29 determined at this time is the tip 33*a* of the projection 33 projecting from the lower surface of the bracket body 31 and the bottom surface 37*a* of the recess 37 fitting the projection 33. A pivot angle A16 of the tension coil spring 16, the bolt 26, and the adjusting and locking nuts 28 and 29 is an angle that the respective axes of the tension coil spring 16, the bolt 26, and the adjusting and locking nuts 28 and 29 form with the reference line BL.

As clearly seen from FIGS. 7A and 7B, in the drum pedal 10 of this embodiment, the pivot fulcrum F16 of the tension coil spring 16 is set in a position lower than that in the conventional drum pedal 110 by the substantially entire length of the bolt 26. This makes the pivot angle A16 of the tension coil spring 16, the bolt 26, and the adjusting and locking nuts 28 and 29 of this embodiment smaller than the pivot angle A101 of the conventional tension coil spring 101. Additionally, force PB of a horizontal component acting on the pivot fulcrum F16 of the tension coil spring 16, the bolt 26, and the adjusting and locking nuts 28 and 29 in this embodiment becomes smaller than force PA of a horizontal component acting on the pivot fulcrum F101 of the conventional tension coil spring 101.

Thus, this embodiment achieves the following effects.

(1) While being fixed to a position near the lower end of the column 18, the bracket 30 supports the tension coil spring 16 together with the bolt 26 and the adjusting and locking nuts 28 and 29 such that the tension coil spring 16 can swing together with the bolt 26 and the adjusting and locking nuts 28 and 29. The pivot fulcrum F16 of the tension coil spring 16 is provided on the lower surface of the bracket 30 contacting the adjusting nut 28. This structure reduces the pivot angle A16 that the axis C16 of the tension coil spring 16 forms with the reference line BL when the tension coil spring 16 pivots back and forth. Specifically, the pivot angle A16 of the tension coil spring 16 is reduced during operation on the pedal 12, thereby reducing the force PB of the horizontal component acting on the pivot fulcrum F16 of the tension coil spring 16. This suppresses the occurrence of backward and forward pivot motion of the entire drum pedal 10 together with the pivot motion of the tension coil spring 16, thereby improving the operability of the pedal 12. Reducing the pivot angle A16 of the tension coil spring 16 during operation on the pedal 12 reduces the force of friction occurring at the pivot fulcrum F16 of the tension coil spring 16. This allows smooth movement of the pedal 12 to further improve the operability of the pedal 12.

(2) The projection 33 of the bracket 30 is the first contact part contacting the tension coil spring 16 indirectly through the bolt 26 and the adjusting nut 28. The recess 37 in the adjusting nut 28 is the second contact part contacting the projection 33 of the bracket 30. This structure provides a fit between the projection 33, which is the first contact part, and the recess 37, which is the second contact part. Thus, the tension coil spring 16 is unlikely to come off the bracket 30 when pivoting back and forth during operation of the pedal 12.

(3) The tip 33*a* of the projection 33 has an arcuate sectional shape. The bottom surface 37*a* of the recess 37 is formed by an arcuate surface of an arcuate sectional shape. The bottom surface 37*a* of the recess 37 in the retainer 36 has an R value set to be larger than that of the tip 33*a* of the projection 33 of the bracket 30. This structure make point contact or line contact between the projection 33, which serves as the first contact part, and the recess 37, which serves as the second contact part. This further reduces the force of friction occurring at the pivot fulcrum F16 of the tension coil spring 16. This allows smoother movement of the pedal 12 to further improve the operability of the pedal 12.

(4) The depth D of the recess 37 in the retainer 36 is set to be less than the height H of the projection 33 of the bracket 30. As shown in FIGS. 6A and 6B, this structure prevents interference between a base end portion 33*b* of the projection 33 and the opening surface 37*b* of the recess 37 from occurring when the tension coil spring 16 pivots back and forth during operation on the pedal 12.

(5) The lower end of the bolt 26 is threaded to corresponding threads in the screw hole 39 in the adjusting nut 28. By operating the adjusting nut 28, the position of the bolt 26 in the direction of the axis is adjusted to control the tension of the tension coil spring 16. In this structure, by adjusting the position of the bolt 26 in the direction of the axis to move the position of the lower end of the tension coil spring 16 up and down, the tension of the tension coil spring 16 can be controlled. By controlling the tension of the tension coil spring 16, the feeling sensed during depression of the pedal 12 and the speed at which the beater 15 returns can be controlled.

(6) The tip 33*a* of the projection 33 extends along a straight line perpendicular to the axis C34 of the vertical hole 34. The two recesses 37 that can fit the projection 33 of the bracket 30 are formed in the upper surface of the retainer 36. Axes of the two recesses 37 cross each other at right angles at a point where they intersect the axis C39 of the screw hole 39. This structure, in which the recess 37 is formed in at least two or more positions of the retainer 36 of the adjusting nut 28, allows finer adjustment of the position of the bolt 26 in the direction of the axis than a structure in which the recess 37 formed in only one position. As a result, the tension of the tension coil spring 16 can be controlled more finely.

(7) The projection 33 is one of a pair of projections 33, and one projection 33 is located on each side of the axis C34 of the vertical hole 34, as indicated in FIG. 4(*b*). In this structure, by making the pair of projections 33 of the bracket 30 fit the recesses 37 in the retainer 36, the tension coil spring 16 is unlikely to come off the bracket 30 when pivoting back and forth, and the tension coil spring 16 is stable when pivoting back and forth.

(8) The locking nut 29 is threaded to the upper end of the bolt 26. The adjusting nut 28 includes the tubular part 38 projecting from the upper surface of the retainer 36. The locking nut 29 is tightened on the bolt 26 until the locking nut 29 abuts on the tip of the tubular part 38 of the adjusting nut 28. In this way, the adjusting nut 28, which is threaded to the bolt 26, is locked with the locking nut 29. This can eliminate the development of backlash between the bolt 26 and the adjusting nut 28.

(9) The vertical hole 34 in the bracket 30 is formed in a tapered shape in a vertical section with the upper opening end 34*a* larger than the lower opening end 34*b*. This structure prevents interference between the circumferential wall of the vertical hole 34 in the bracket 30 and the tubular part 38 of the adjusting nut 28 from occurring when the tension coil spring 16 pivots back and forth.

(10) The projection 33 projects from the lower surface of the bracket body 31. The recess 37 is formed in the upper surface of the retainer 36. In this structure with the projection 33 provided on the lower surface of the bracket body 31 and the recess 37 in the upper surface of the adjusting nut 28, the pivot fulcrum F16 of the tension coil spring 16 can be set to be lower in position than the bracket 30. This can reduce the pivot angle A16 further the axis C16 of the tension coil spring 16 forms with the reference line BL when the tension coil spring 16 pivots back and forth. Specifically, the pivot angle A16 of the tension coil spring 16 is reduced further during operation on the pedal 12, thereby further improving the operability of the pedal 12.

This embodiment can be changed as follows.

Figure 8:
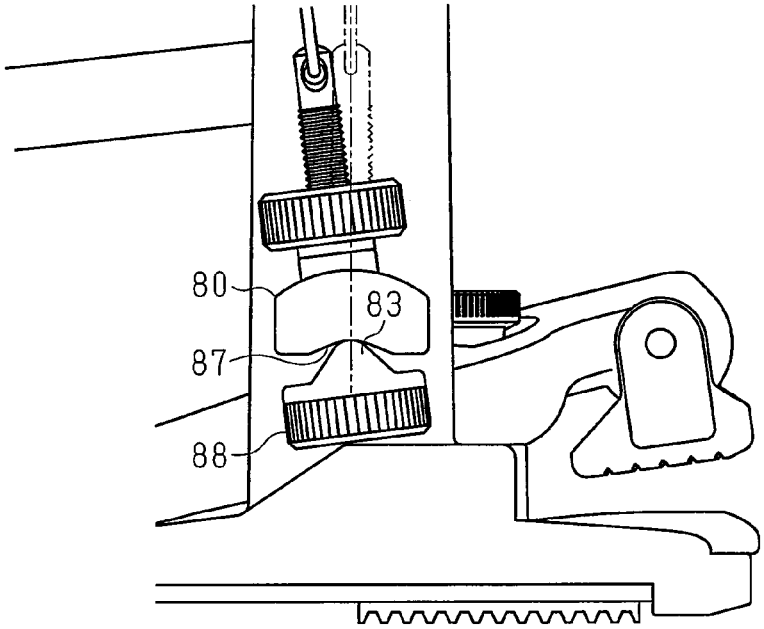
FIGS. 8 and 9 are partial side views each showing a bracket and its vicinity of a pedal device in an enlarged manner according to a different example.

As shown in FIG. 8, a recess 87, which serves as the first contact part, may be formed on a bracket 80 and a projection 83, which serves as the second contact part, may be provided on an adjusting nut 88.

Figure 9:
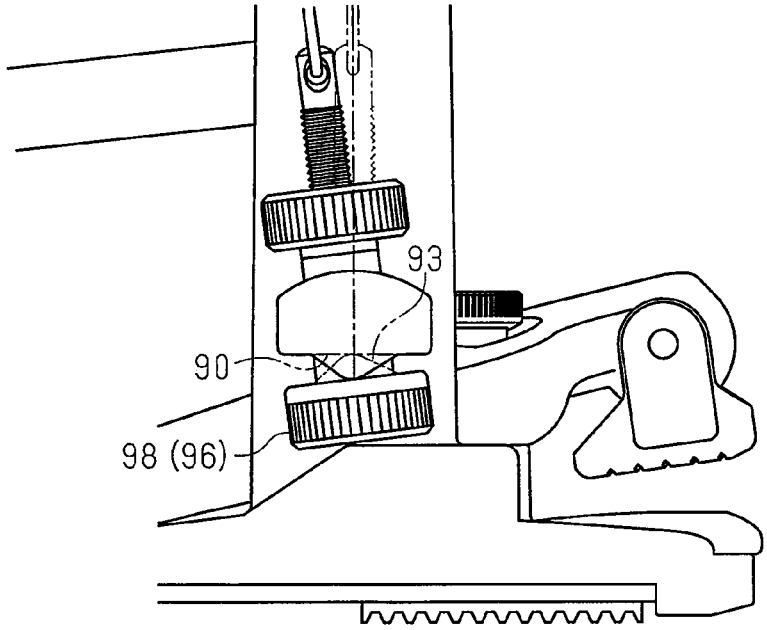

As shown by solid lines in FIG. 9, a retainer 96 of an adjusting nut 98 may not have a recess. As shown by broken lines in FIG. 9, the lower surface of a bracket 90 may be flat and a projection 93, which serves as the second contact part, may be provided on the adjusting nut 98.

This embodiment employs the structure where the tension coil spring 16 pivots together with the bolt 26 and the adjusting and locking nuts 28 and 29 relative to the bracket 30. However, this is not limitation requirement. As an example, the bracket 30 may support the lower end of the tension coil spring 16 directly while the bolt 26 and the adjusting and locking nuts 28 and 29 are omitted. In this structure, to prevent the tension coil spring 16 from coming off the bracket 30, a projection, as the second contact part, may be provided on the tension coil spring 16 and a recess, as the first contact part, may be formed in the lower surface of the bracket 30.

In this embodiment, the tip 33*a* of an arcuate sectional shape of the projection 33 may be replaced by a pointed tip. The bottom surface 37*a* formed of an arcuate surface of the recess 37 may be replaced by a bottom surface of a triangular sectional shape.

In this embodiment, the tip 33*a* of the projection 33 extends along a straight line perpendicular to the axis C34 of the vertical hole 34 to form a line contact with the bottom surface 37*a* of the recess 37. However, this is not limitation requirement. As an example, the tip 33*a* of the projection 33 may be formed in a conical or spherical shape to make point contact with the bottom surface 37*a* of the recess 37.

In this embodiment, the number of the recesses 37 formed in the upper surface of the retainer 36 may be changed to one or three or more.

In this embodiment, the locking nut 29 threaded to the upper end of the bolt 26 may be omitted or the tubular part 38 may be omitted from the adjusting nut 28.

In this embodiment, the vertical section of the vertical hole 34 in the bracket 30 may be changed from a tapered shape to a straight shape as long as such a shape can prevent interference between the circumferential wall of the vertical hole 34 and the tubular part 38 of the adjusting nut 28.

In this embodiment, the unit body 11 may have only one column instead of the columns 18 in a pair extending upward from the front end of the base 17. In this structure, the shaft 14 becomes a cantilever supported on the upper end of one column.

In this embodiment, the shaft 14 may not be required to be rotationally supported on the respective upper ends of the columns 18 in a pair. In this case, the shaft 14 may be fixed to the respective upper ends of the columns 18 in a pair and the wheel 22 may be rotationally supported on the shaft 14.

This invention is described as being applied to the pedal device with a single pedal. Alternatively, this invention may be applied to a pedal device with twin pedals.

The invention claimed is:

1. A pedal device for a drum, the pedal device comprising:

a unit body having a base and a column extending upward from a front end of the base;

a pedal rotationally attached to a rear end of the base;

a shaft supported on an upper end of the column;

a beater provided on the shaft, wherein the beater rotates around an axis of the shaft to beat a drum;

a crank arm that rotates around the axis of the shaft together with the beater;

a transmission member coupled to a free end of the pedal, wherein the transmission member transmits operating force of the pedal to the beater;

a spring with an upper end coupled to the crank arm and a lower end supported on the unit body, wherein the spring has an axis, a bracket provided on the unit body, wherein the bracket supports the spring in a manner allowing the spring to swing, a bolt coupled to the lower end of the spring, wherein the bolt has an upper end located above the bracket and a lower end located below the bracket, and an adjusting nut engaged with the lower end of the bolt, wherein the adjusting nut is operable to adjust the position of the bolt in a direction of an axis of the bolt, wherein the pedal is held in a standby position by the spring while the axis of the spring lies in a common plane with a reference line connecting the lower end of the spring and a rotation center of the crank arm, the operating force of the pedal is transmitted through the transmission member to the beater to rotate the beater, and the crank arm rotating together with the beater causes the spring to swing back and forth about the lower end of the spring, which is a fulcrum, the spring swings together with the bolt and the adjusting nut about a common fulcrum, and the fulcrum of the spring is provided on a lower surface of the bracket.

2. The pedal device for a drum according to claim 1, wherein the bracket is provided with a first contact part, which contacts the spring, the spring is provided with a second contact part, which contacts the bracket, and one of the first and second contact parts is formed of a projection and the other is formed of a recess.

3. The pedal device for a drum according to claim 2, wherein the recess is formed to have an arcuate sectional shape, the projection has a tip of an arcuate sectional shape, and the recess has an arcuate surface of an R value larger than that of the tip of the projection.

4. The pedal device for a drum according to claim 2, wherein the recess has a depth that is less than the height of the projection.

5. The pedal device for a drum according to claim 2, wherein the bracket has a vertical hole through which the bolt passes, the upper end of the bolt extends upward from the vertical hole and the lower end of the bolt extends downward from the vertical hole; and one of the projection and the recess is provided on the bracket and the other is provided on the adjusting nut.

6. The pedal device for a drum according to claim 5, wherein the projection has a tip extending along a straight line perpendicular to an axis of the vertical hole in the bracket or an axis of the adjusting nut, and the recess is capable of fitting the tip of the projection is provided in at least two or more positions of the bracket or the adjusting nut.

7. The pedal device for a drum according to claim 5, wherein the projection is one of a pair of projections with respect to an axis of the vertical hole in the bracket or an axis of the adjusting nut as a center.

8. The pedal device for a drum according to claim 5, comprising a locking nut threaded to the upper end of the bolt, wherein the upper surface of the adjusting nut is provided with a tubular part with a passage hole that lets the bolt pass through, and the locking nut abuts on a tip of the tubular part to lock the adjusting nut.

9. The pedal device for a drum according to claim 5, wherein the vertical hole in the bracket is tapered so that an upper opening end of the vertical hole larger than a lower opening end of the vertical hole.

10. The pedal device for a drum according to claim 5, wherein the projection is provided on the lower surface of the bracket, and the recess is provided on the upper surface of the adjusting nut.

* * * * *